US010669917B1

(12) United States Patent
Atwell

(10) Patent No.: US 10,669,917 B1
(45) Date of Patent: Jun. 2, 2020

(54) RV GENERATOR AUXILIARY EXHAUST SYSTEM AND METHOD

(71) Applicant: Jacob Christopher Atwell, Greensboro, NC (US)

(72) Inventor: Jacob Christopher Atwell, Greensboro, NC (US)

(73) Assignee: Camco Manufacturing, Inc., Greensboro, NC (US)

( * ) Notice: Subject to any disclaimer, the term of this patent is extended or adjusted under 35 U.S.C. 154(b) by 0 days.

(21) Appl. No.: 16/242,229

(22) Filed: Jan. 8, 2019

(51) Int. Cl.
*F01N 13/00* (2010.01)
*F01N 13/08* (2010.01)
*F01N 13/18* (2010.01)

(52) U.S. Cl.
CPC ..... *F01N 13/08* (2013.01); *F01N 13/1822* (2013.01); *F01N 2340/04* (2013.01); *F01N 2450/10* (2013.01)

(58) Field of Classification Search
CPC ..... F01N 3/22; F01N 1/22; F01N 13/1822
See application file for complete search history.

(56) References Cited

U.S. PATENT DOCUMENTS 3,563,030 A * 2/1971 Lentz et al. ..... F01N 3/22 60/288
3,746,126 A * 7/1973 de Cardenas ..... F01N 1/12 181/227
4,155,289 A * 5/1979 Garriss ..... B08B 15/023 118/326
5,197,509 A * 3/1993 Cheng ..... F15D 1/04 137/13
5,839,473 A 11/1998 Caine et al.
6,050,284 A 4/2000 Caine et al.
9,365,368 B2 * 6/2016 Seibt ..... B64D 11/02
9,719,680 B2 * 8/2017 Staller ..... F23J 11/08
2008/0057848 A1 * 3/2008 Gray ..... B64D 41/00 454/69
2017/0356325 A1 * 12/2017 Zhang ..... F02M 26/22

* cited by examiner

*Primary Examiner* — Hau V Phan
(74) *Attorney, Agent, or Firm* — Tuggle Duggins P.A.; Blake P. Hurt

(57) ABSTRACT

An auxiliary exhaust system for an internal combustion generator of a recreational vehicle has an elbow section with a proximal end adapted to be removably attached to an exhaust pipe of a generator and a remote end affixed to a first stack section; a second stack section adapted to be removably attached to a remote end of the first stack section, and a terminal stack section adapted to be removably affixed to a remote end of the second stack section, the stack sections together forming a fluid conduit for exhaust gases; the inlet end of the first stack section having restricted diameter portion to create a venturi effect on gases flowing through the first stack section; wherein the remote end of the elbow section is of smaller diameter than the inlet end of the first stack section and is held in concentric, spaced-apart relation to the inlet end of the first stack section to enable ambient air to be drawn into the inlet end of the first stack section as gases are passed through the auxiliary exhaust system.

16 Claims, 3 Drawing Sheets

RV GENERATOR AUXILIARY EXHAUST SYSTEM AND METHOD

FIELD OF THE INVENTION

The invention herein pertains to exhaust systems for internal combustion engines, and in particular to auxiliary exhaust systems for generator motors as are used on recreational vehicles.

DESCRIPTION OF THE PRIOR ART AND OBJECTIVES OF THE INVENTION

In recent years there has been an increase in the number of recreational vehicles, such as motor homes, campers and the like, in use as more families travel about on vacations, weekend leisure travel and pursuing various interests. Parks and campgrounds and other venues where recreational vehicles are utilized, such as sporting events, are becoming increasingly more crowded, resulting in smaller and narrower parking spaces and a higher vehicle density. Accordingly, there is less "free" space around each recreational vehicle.

Many recreational vehicles are equipped with a generator to supply electrical power. The generators have an internal combustion engine using a combustible fuel such as gasoline, diesel, propane, etc. The generators are often located beneath the vehicle and have an exhaust system positioned near ground level. The exhaust fumes created by the generators contain noxious gases and can be not only a nuisance, but also a health hazard to individuals nearby, especially when the exhaust is discharged close to the ground. The problem is exacerbated in higher vehicle density environments.

To try an alleviate this concern, auxiliary exhaust systems have been developed for recreational vehicles which attach to the exhaust port of the generator and discharge the exhaust gases above the roof of the recreational vehicle. See for example, U.S. Pat. Nos. 5,839,473 and 6,050,284, the assignee of the subject application, the entire disclosures of which are hereby incorporated by reference.

Prior art auxiliary exhaust systems were formed from lengths of metal tubes that were connected together to form a conduit for the exhaust gases. However, exhaust gases from internal combustion motors are very hot and would cause the metal tubing to become a burn hazard for anyone who might come in contact with the metal. In addition, these prior art metal auxiliary exhaust systems are expensive, heavy and difficult to attach, remove and store.

Flexible plastic hoses have also been used as auxiliary exhaust systems. While lighter than their metal counterparts, and sometimes less expensive, the plastic hoses could also become very hot to the touch and presented a similar burn hazard. Because of their relative flexibility, these pipe systems were also difficult to keep in a desired orientation to direct the exhaust fumes in a safe direction.

Apart from the exhaust fumes, generators can be noisy, also a problem that is exacerbated when in close quarters. Noise from the generators arises from two sources: vibration and the actual discharge of gases from the exhaust pipe. Vibration noise is minimized in many instances by the manufacturer of the recreational vehicle using some type of vibration dampening material, such as rubber, when mounting the generator. Any auxiliary exhaust system that directs the exit of the exhaust gases above the roof line and thus farther from the listener will alleviate some of the noise concerns. However, the auxiliary exhaust systems made of metal tubing did not adequately address the noise issue as the metal tubing introduced further vibration into the exhaust system.

Thus, with the problems and disadvantages of prior art exhaust systems for recreational vehicle generators, the present invention was conceived and has as an objective to provide an auxiliary exhaust system which can be easily assembled, attached, stabilized, disassembled and stored.

It is another objective of the present invention to provide an auxiliary exhaust system and method which allows adjustability in its vertical positioning as needed by adding or removing exhaust stack sections.

It is a further objective of the present invention to provide an auxiliary exhaust system containing a venturi-style valve, broadly defined as any valve structure that facilitates the Venturi effect.

It is yet a further objective of the invention to provide an auxiliary exhaust system that remains relatively cool to the touch during operation compared to other prior art solutions.

It is a still another objective of the present invention to provide an auxiliary exhaust system which utilizes rigid lightweight tubular sections, preferably formed from a polymeric material.

It is yet another objective of the invention to provide an auxiliary exhaust system that has improved efficiency over prior art systems, specifically as it pertains to fluid or gas flow.

Various other objectives and advantages of the present invention will become apparent to those skilled in the art as a more detailed description is set forth below.

SUMMARY OF THE INVENTION

These and other objectives are realized by providing an auxiliary exhaust system particularly suited for use on a generator of a recreational vehicle. The auxiliary exhaust system has an elbow section with a proximal end adapted to be removably attached to an exhaust pipe of a generator, and a remote end affixed to a first stack section; a second stack section adapted to be removably attached to a remote end of the first stack section, and a terminal stack section adapted to be removable affixed to a remote end of the second stack section. An inlet end of the first stack section is provided with venturi valve to create a venturi effect on gases flowing through the first stack section. The remote end of the elbow section is of smaller diameter and mounted in concentric, spaced-apart relationship from the inlet end of the first stack section to enable ambient air to be drawn into the inlet end of the first stack section as gases are passed through the auxiliary exhaust system. The first stack section is also provided with a pair of shock cords to facilitate attachment of the first stack section to a recreational vehicle.

DETAILED DESCRIPTION OF THE PREFERRED EMBODIMENT AND OPERATION OF THE INVENTION

Figure 1:
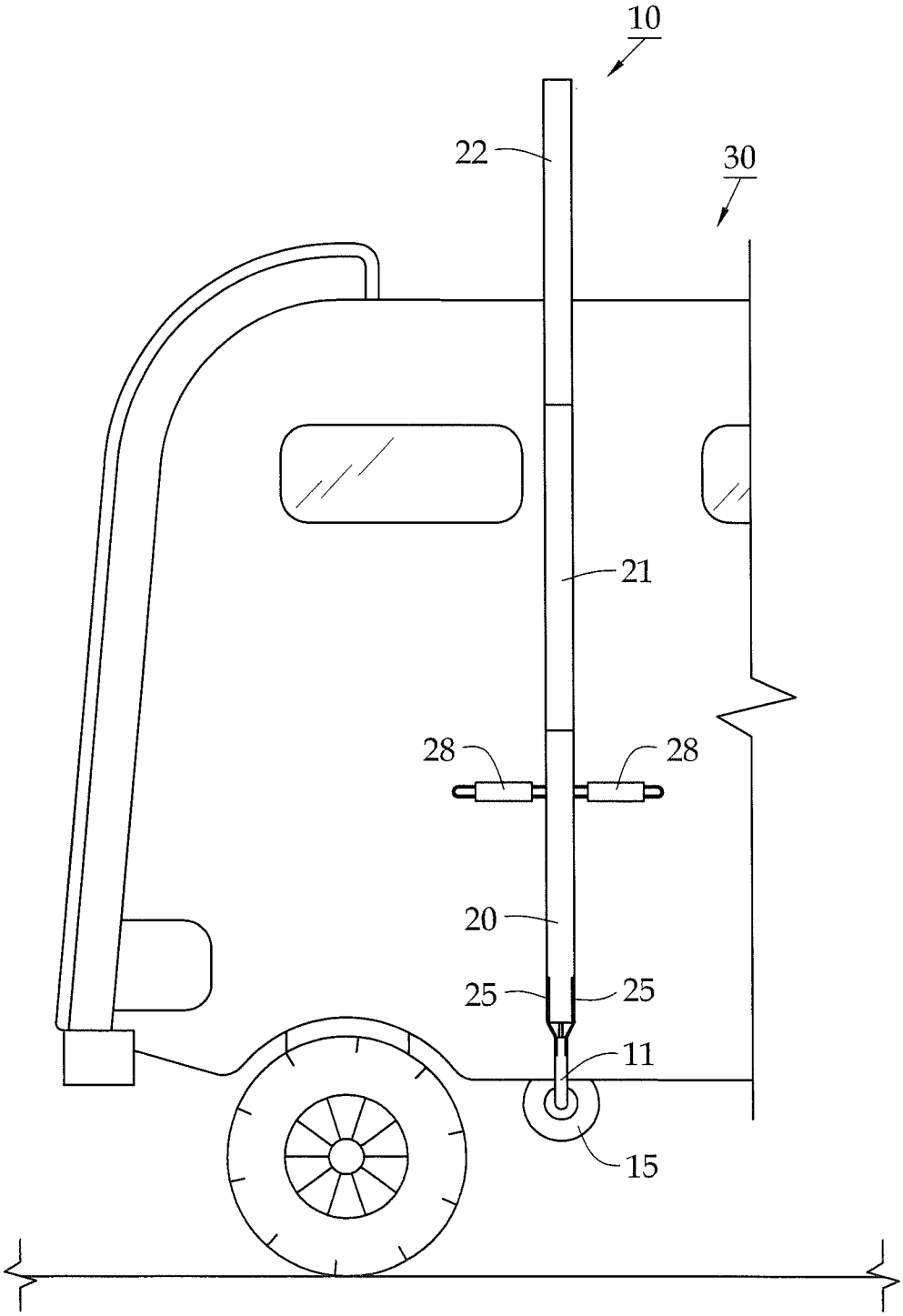
FIG. 1 is a schematic illustration of a recreational vehicle showing the auxiliary exhaust system of the invention affixed thereto.

For a better understanding of the invention and its operation, turning now to the drawings, FIG. 1 illustrates the auxiliary exhaust system 10 attached to a typical recreational vehicle 30. The recreational vehicle (also known simply by the abbreviation "RV") is equipped with an electrical generator powered by an internal combustion motor 16 (see FIG. 2). The motor 16 preferable has an exhaust system including a muffler 15 and a tail pipe 34 (see FIG. 2), as is typical for internal combustion engines. The muffler 15 and tail pipe 34 are usually oriented generally horizontal and parallel to the ground.

The preferred auxiliary exhaust system 10 has an elbow section 11 that is adapted (i.e. sized and shaped) to be removably mounted to at least a portion of the tail pipe 34 at a proximate end and is attached to the first stack section 20 at an opposing, more remote end. Second stack section 21 is removably connected to first stack section 20 and terminal stack section 22 is removably connected to second stack section 21, whereby stack sections 20, 21, 22 form a fluid communication conduit for exhaust gases.

As shown in FIG. 1, the terminal end of terminal stack section 22 is located above the roof line of the RV 30, which is desirable to ensure that noxious exhaust fumes are directed away from neighboring vehicles or individuals, and also from the standpoint of reduced exhaust noise. While not illustrated in the Figures, it will be understood that additional stack sections 21 may be employed as desired to achieve the appropriate height. It should be noted that while the preferred embodiment has been described herein, neither the number nor shape of the stack sections are intended to serve as a limitation to the present invention. It is within the scope of the instant invention to incorporate more or fewer stack sections as desirable, and a wide variety of geometries may combine to form a conduit for exhaust gases and still serve the intended purpose herein.

As also seen in FIG. 1, the first stack section 20 is preferably equipped with a pair of tensioning members embodied as shock cords 28, 28 that can be attached to the RV 30 in any suitable manner. The shock cords 28, 28 serve to stabilize the stack sections 20, 21, 22 against wind and other forces that might tend to change the orientation of the stack sections 20, 21, 22 relative to the RV 30 and also to reduce vibration noises from the flow of exhaust gases through the stack sections. While the stack sections 20, 21, 22 are shown in FIG. 1 as oriented vertically, it will be understood that the auxiliary exhaust system 10 may be rotated between the horizontal and the vertical as desired (or a variety of angular postures therebetween) or dictated by the circumstances and RV to which it is attached. For example, it may be necessary to angle the stack sections 20, 21, 22 forward or rearward (relative to the vertical) to avoid obstructing a window, door way or access panel on the RV. Those skilled in the art will understand that additional shock cords 28, 28 may be employed on the second stack section 21 or the terminal stack section 22 as is necessary to stabilize the stack sections. Shock cords 28, 28 are attached to first stack section 20 by screws or other suitable fasteners. Shock cords 28, 28 can comprise resilient rubber straps, springs or other suitable materials to secure the stack section to the RV to prevent undesired movement and absorb some vibrations.

Figure 2:
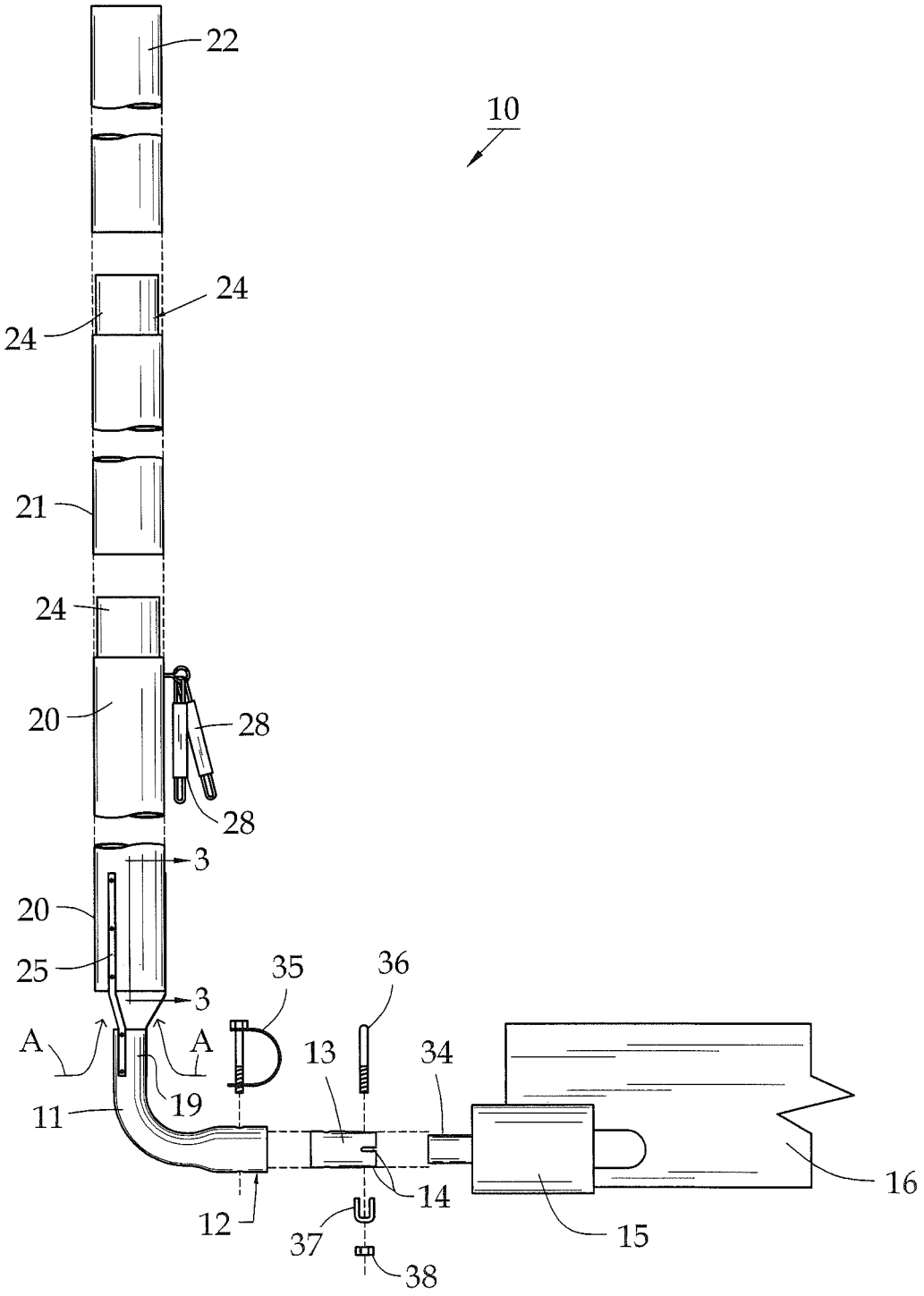
FIG. 2 is an exploded side elevational view of a preferred embodiment of the auxiliary exhaust system.

FIG. 2 shows an exploded side elevational view of the preferred embodiment of the auxiliary exhaust system 10. As seen in FIG. 2, the elbow section 11 preferably defines a flared proximate end 12 to facilitate attachment to at least a portion of the elbow section 11 to the tail pipe 34 of the motor 16 for the RV generator. The elbow section 11 is preferably made of metal and has an inside diameter of approximately 38 mm and an outside diameter of approximately 40 mm. While in some applications the elbow section 11 may be attached directly to the tail pipe 34, in most cases an adapter, such as coupler adapter 13, may be required. The coupler adapter 13 has slotted apertures 14 at one end thereof to enable the diameter of the coupler adapter 13 to be enlarged or reduced slightly so as to accommodate, for example, tail pipes that have corrosion or tail pipes that might be slightly out of round.

The coupler adapter 13 may be affixed to the tail pipe 34 by a conventional muffler clamp, comprising a U-shaped double threaded bolt 36, a backer plate 37 and nuts 38 (only one shown in FIG. 2). To facilitate attachment and detachment of the auxiliary exhaust system 10, it is advantageous for the coupler adapter 13 to remain attached to the tail pipe 34. The elbow section 11 may be removably attached to the coupler adapter 13 by a spring bail pin 35, as shown in FIG. 2.

The remote end 19 of elbow section 11 is affixed to the first stack section 20 by a plurality of fasteners such as brackets 25 that are affixed to an inlet end of the first stack section 20 and the remote end 19 of the elbow section 11. The remote end 19 of elbow section 11 preferably defines a smaller diameter than the inlet end of first stack section 20 and the brackets 25 maintain the first stack section 20 in a concentric orientation relative to the remote end 19 of elbow section 11. In addition, as seen in FIG. 2, the brackets 25 preferably hold the remote end 19 of elbow section 11 in spaced-apart relationship to the inlet end of the first stack section 20. In this configuration, ambient air is allowed to be drawn into the inlet end of first stack section 20 as exhaust gases pass from the remote end 19 of elbow section 11 into first stack section 20 as indicated by arrows A of FIG. 2.

The first stack section 20 preferably defines a reduced diameter or "necked-down" terminal end 24 to enable the first stack section to be removable attached to a second stack section 21 by sliding the end of stack section 21 over the necked down terminal end 24. Similarly, second stack section 21 preferably defines a necked down terminal end 24 to facilitate attachment of the terminal stack section 22 to the second stack section 21. Stack sections 20, 21 and 22 are preferably made from polycarbonate, a lightweight, durable material that has high impact resistance and poor thermal conductive properties. As a result, the external surface of the stack sections 20, 21, 22 reduce or prevent the transfer of heat from the exhaust gases to the external surface of the stack section, thus reducing the risk of burn injury should someone come in contact with the stack sections during operation. Preferred embodiments of stack sections 20, 21, 22 may have a nominal internal diameter of approximately 76 mm and a nominal external diameter of approximately 78 mm.

Figure 3:
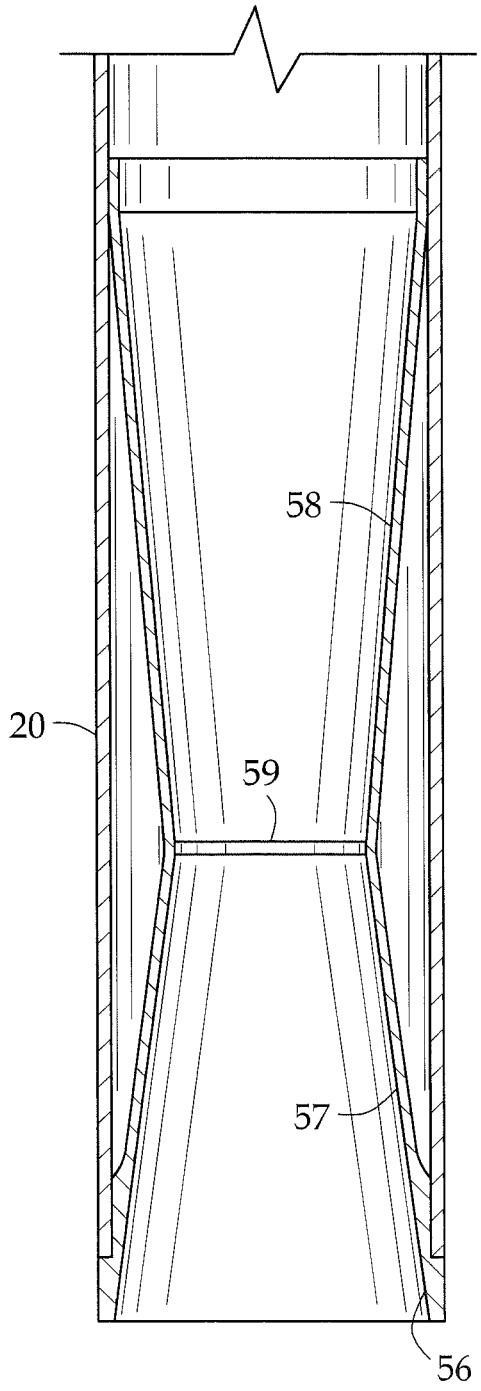
FIG. 3 is an enlarged cross-sectional view of the inlet end of the first stack section as seen along lines and arrows 3-3 of FIG. 2, particularly illustrating the venturi valve.

FIG. 3 is a cross-sectional elevational view of the inlet end of the first stack section 20. As seen therein, the inlet end of the first stack section 20 has a segment of reduced diameter, forming a venturi valve and creating a venturi effect within the first stack section 20 as the exhaust gases pass from the remote end 19 of elbow section 11 into the first stack section 20. Named after Giovanni Battista Venturi, an Italian physicist, the Venturi Effect stands for the proposition that the reduction in fluid pressure results when a fluid flows through a constricted section (or choke) of a pipe. In fluid dynamics, an incompressible fluid's velocity must increase as it passes through a constriction in accord with the principle of mass continuity, while its static pressure must decrease in accord with the principle of conservation of mechanical energy. Thus any gain in kinetic energy a fluid may accrue due to its increased velocity through a constriction is balanced by a drop in pressure. In the embodiment of FIG. 3, the inlet end of first stack section 20 is provided with an insert 56 that defines a classic venturi "hour glass" shape, comprised of an entry cone 57 and an exit cone 58 with a constricted diameter portion 59 at the interface. For a typical venturi valve, the entry cone will have an angle of about thirty (30) degrees and the exit cone will have an angle of about five (5) degrees. The insert 56 is friction fit within the inlet end of the first stack section 20. It will be understood by the skilled artisan that the venturi valve may be formed integral with the first stack section 20 and that alternate embodiments for introducing a venturi valve into the stack section may be possible.

The venturi effect created by the valve located within the inlet of the first stack section 20 has been found to increase the air flow through the stack sections 20, 21, 22 by a statistically significant amount over the prior art, specifically 20% or more, thus increasing the efficiency of the auxiliary exhaust system. Thus increased airflow, in combination with the introduction of ambient air introduced at the gap between the elbow section and the first stack section, has shown to decrease the temperature on the external surface of the stack sections significantly, and thus further reducing the possibility of a burn when coming in contact with the stack sections.

In a particularly preferred method of use, an appropriately sized coupler adapter 13 is connected to a tailpipe 34 of an internal combustion motor 16 on an RV. The proximate end 12 of elbow section 11, with the first stack section 20 attached, is removably connected to an opposite end of the coupler adapter, such as by a spring bail clip, and the first stack section is secured to the RV by the shock cords. Second stack section 21 is then attached to the first stack section 20 by sliding the large diameter end of stack section 22 over the necked down portion 24 of stack section 20. Additional stack sections 21 may be added as needed to achieve the desired height before sliding the terminal stack section 22 in place over the necked down end 24 of stack section 21.

The illustrations and examples provided herein are for explanatory purposes and are not intended to limit the scope of the appended claims. Changes in the shapes and materials employed herein are anticipated by those skilled in the art as different plastics, sizes and configurations may be used as available without departing from the inventive concept divulged.

I claim:

1. An auxiliary exhaust system for a recreational vehicle, the auxiliary exhaust system comprising:

an elbow section with a proximate end adapted to be removably attached to a tail pipe of an internal combustion motor on a generator, and a remote end affixed to a first stack section via a plurality of brackets attached to an exterior surface of the first stack section and the remote end of the elbow section, the plurality of brackets adapted to hold the remote end of the elbow section in a spaced-apart relationship relative to the first stack section to enable ambient air to be drawn into the first stack section;

a second stack section adapted to be removably attached to a remote end of the first stack section, the stack sections together forming a fluid conduit for exhaust gases;

wherein the first stack section is provided with a venturi valve on an interior diameter of the first stack section; and wherein the remote end of the elbow section is disposed concentric with the first stack section.

2. The auxiliary exhaust system of claim 1, wherein the venturi valve comprises an insert that is friction fit to the interior of the first stack section.

3. The auxiliary exhaust system of claim 1, wherein the venturi valve defines an hour glass shaped member having an entry cone, an exit cone and a reduced diameter section between the entry cone and the exit cone.

4. The auxiliary exhaust system of claim 1, wherein the first stack section and the second stack section are formed of polycarbonate.

5. The auxiliary exhaust system of claim 1, wherein the elbow section is made of steel.

6. The auxiliary exhaust system of claim 1, wherein the proximate end of the elbow section defines a flare to form an enlarged diameter.

7. The auxiliary exhaust system of claim 1, further comprising a pair of shock cords affixed to the first stack section and adapted for removable attachment to a recreational vehicle.

8. The auxiliary exhaust system of claim 1, further comprising a coupler adapter, the coupler adapter being adapted for attachment to a tail pipe of an internal combustion motor at one end and adapted for attachment at an opposite end to the proximate end of the elbow section.

9. The auxiliary exhaust system of claim 1, wherein the venturi valve comprises an insert that is friction fit to the interior of the first stack section; and wherein the venturi valve comprises an hour glass shaped member having an entry cone, an exit cone and a reduced diameter section between the entry cone and the exit cone.

10. A method of exhausting gases from an internal combustion generator motor on a recreational vehicle, the process comprising the steps of:

connecting a first end of a coupler adapter to a tail pipe of the internal combustion generator;

attaching a proximate end of an elbow section to a second end of the coupler adapter, the elbow section having a first stack section connected thereto at a remote end via a plurality of brackets attached to an exterior surface of the first stack section and the remote end of the elbow section, the plurality of brackets adapted to hold the remote end of the elbow section in a spaced-apart relationship relative to the first stack section to enable ambient air to be drawn into the first stack section;

connecting at least one second stack section to the first stack section, whereby the first stack section and the second stack section form a fluid conduit for exhaust gases; wherein an inlet end of the first stack section is provided with a venturi valve on an interior diameter of the first stack section; wherein the remote end of the elbow section is of smaller diameter than the inlet end of the first stack section; wherein the remote end of the elbow section is disposed concentric with the inlet end of the first stack section.

11. The method of claim 10, wherein the venturi valve comprises an insert that is friction fit to the interior of the first stack section; and wherein the venturi valve comprises an hour glass shaped member having an entry cone, an exit cone and a reduced diameter section between the entry cone and the exit cone.

12. The method of claim 10, further comprising the step of attaching the first stack section to the recreational vehicle by a pair of shock cords.

13. The method of claim 10, wherein the first stack section and the second stack section are made of polycarbonate.

14. The method of claim 10, wherein the proximate end of the elbow section is flared out to form an enlarged diameter.

15. The method of claim 10, wherein the first stack section and the at least one second stack section each have a necked down end portion to fit within a diameter of an adjacent stack section.

16. The method of claim 10, wherein the elbow section is made of steel.

* * * * *